US006715502B1

(12) United States Patent
Rome et al.

(10) Patent No.: US 6,715,502 B1
(45) Date of Patent: Apr. 6, 2004

(54) AUTOMATIC FUEL SYSTEM CLEANER

(75) Inventors: John A. Rome, Huntington, CA (US); Bill Kavadeles, Carlsbad, CA (US); Jesus G. Orejel, Santa Ana, CA (US)

(73) Assignee: Motorvac Technologies, Inc., Santa Ana, CA (US)

( * ) Notice: Subject to any disclaimer, the term of this patent is extended or adjusted under 35 U.S.C. 154(b) by 257 days.

(21) Appl. No.: 09/929,579

(22) Filed: Aug. 14, 2001

Related U.S. Application Data

(60) Provisional application No. 60/293,909, filed on May 25, 2001.

(51) Int. Cl.[7] ..... B08B 3/04

(52) U.S. Cl. ..... 134/169 A; 134/111; 141/98; 141/99

(58) Field of Search ..... 134/95.1, 98.1, 134/99.1, 103.1, 111, 113, 169 R, 169 A; 141/59, 98, 99; 123/198 A

(56) References Cited

U.S. PATENT DOCUMENTS 4,787,348 A * 11/1988 Taylor ..... 123/198 A
4,877,043 A * 10/1989 Carmichael et al. ..... 134/57 R
5,289,837 A * 3/1994 Betancourt ..... 134/57 R
5,443,085 A * 8/1995 Huddas ..... 134/95.1
5,833,765 A * 11/1998 Flynn et al. ..... 134/22.12
6,213,175 B1 * 4/2001 Rome et al. ..... 141/98
6,263,889 B1 * 7/2001 Flynn et al. ..... 134/102.2

* cited by examiner

*Primary Examiner*—Randy Gulakowski
*Assistant Examiner*—Joseph L. Perrin
(74) *Attorney, Agent, or Firm*—Farjami & Farjami LLP

(57) ABSTRACT

An apparatus and method for cleaning either a diesel or a gasoline fuel system. The automatic fuel cleaner apparatus comprises a diesel service portion and a gasoline service portion. The diesel and gasoline service portions each includes a return hose having a first end capable of being coupled to a fuel line outlet of the fuel system. Each service portion further includes a detergent reservoir having an input connected to the return hose. Each service portion also includes a pump having an input connected to an output of the detergent reservoir. The diesel and gasoline service portions each further includes an output hose having a first end connected to a pump output and a second end capable of being coupled to a fuel line inlet. The gasoline service portion also comprises a pressure regulator connected to the output of the gasoline pump.

6 Claims, 6 Drawing Sheets

AUTOMATIC FUEL SYSTEM CLEANER

RELATED APPLICATIONS

The present application claims the benefit of U.S. provisional application serial No. 60/293,909, filed May 25, 2001, which is hereby fully incorporated by reference in the present application.

BACKGROUND OF THE INVENTION

1. Field of the Invention

The present invention relates generally to servicing fuel systems. More particularly, the present invention relates to method and apparatus for cleaning vehicle engine fuel systems.

2. Related Art

One area of vehicular maintenance concerns the removing and cleaning of carbon deposits from gas and diesel internal combustion engine fuel systems. Fuel injectors, fuel rail components, and intake manifold cavities become clogged and operate inefficiently due to the normal accumulation of carbon and petroleum varnish byproducts. The deposits tend to accumulate and clog orifices and critical fuel combustion pathways and conduits, including fuel rail assemblies and fuel injectors that carry the atomized fuel mixture into the combustion chamber. If the nozzles and related components operate ineffectively or fuel nozzle spray patterns are altered due to carbon or contaminates, fuel efficiency and engine performance decrease and emissions levels become excessive.

The conventional method used to remove and clean carbon deposits from gas and diesel internal combustion engine fuel systems requires a mechanic to dismantle the entire fuel system. The fuel systems components, such as the fuel injectors and fuel rail components, are then mechanically or chemically cleaned. However, certain emission control devices that are designed into the fuel system are constructed of molded plastic and cannot be dismantled. Therefore, if one of these emission control devices does not operate properly because an element inside the device, such as a diaphragm, is dirty, the emission control device must be replaced. Thus, there is a need for a fuel system cleaner that can clean the fuel system components of gasoline and diesel engine fuel systems without requiring the dismantling of the fuel system components or the cost of unnecessary replacement of fuel system components.

A fuel system cleaner that is used to service a gasoline engine fuel system cannot be used to service a diesel engine fuel system without proper preparation. For example, after a fuel system cleaner services a gasoline fuel system, all gasoline needs to be flushed out of the tanks and hoses of the fuel system cleaner prior to servicing a diesel engine fuel system. Additionally, it is necessary to replace the fuel system cleaner's filter prior to servicing a diesel fuel system. Also, since a diesel fuel system operates at low pressure, a fuel system cleaner that is used to service a diesel fuel system must regulate the diesel pressure so that it does not exceed approximately 15.0 psi (pounds per square inch). On the other hand, a gasoline fuel system operates at high pressure and requires the fuel system cleaner to regulate the gasoline pressure from approximately 40.0 to 120.0 psi. A fuel system cleaner that services a diesel fuel system requires similar preparation before the fuel system cleaner can service a gasoline fuel system.

Therefore, there exists a need for a fuel system cleaner that can service both gasoline and diesel engine fuel systems without requiring the dismantling of fuel system components or the cost of unnecessary replacement of fuel system components. Further, there exists a need for a fuel system cleaner that can switch from gasoline to diesel or from diesel to gasoline fuel system servicing without requiring prior flushing of the fuel system cleaner or filter replacement, and providing proper regulation of either gasoline or diesel fuel pressure during fuel system servicing.

SUMMARY OF THE INVENTION

The present invention is directed to apparatus and method for cleaning either a diesel or a gasoline fuel system. More specifically, the invention provides for automatic cleaning either a diesel or a gasoline fuel system without requiring dismantling of fuel system components or unnecessary replacement of fuel system components.

In one aspect, an automatic fuel cleaner apparatus comprises a diesel service portion for cleaning diesel fuel systems. The diesel service portion includes a diesel return hose having a first end and a second end, the first end of the diesel return hose capable of being coupled to a fuel line outlet of the diesel fuel system. The diesel service portion further includes a diesel detergent reservoir having an input and an output, the input of the diesel detergent reservoir being connected to the second end of the diesel return hose.

The diesel service portion also includes a diesel pump having a diesel pump output and a diesel pump input, the diesel pump input being connected to the output of the diesel detergent reservoir. For example, the diesel pump input can be connected to the output of the diesel detergent reservoir via a diesel filter. The diesel service portion further includes a diesel output hose having a first end and a second end, the first end of the diesel output hose being connected to the diesel pump output and the second end of the diesel output hose capable of being coupled to the fuel line inlet. For example, the first end of the diesel output hose can be connected to the diesel pump output via a diesel relief valve.

The automatic fuel cleaner apparatus also comprises a gasoline service portion for cleaning gasoline fuel systems. The gasoline service portion includes a gasoline return hose having a first end and a second end, the first end of the gasoline return hose capable of being coupled to a fuel line outlet of the gasoline fuel system. The gasoline service portion further includes a gasoline detergent reservoir having an input and an output, the input of the gasoline detergent reservoir being connected to the second end of the gasoline return hose.

The gasoline service portion also includes a gasoline pump having a gasoline pump output and a gasoline pump input, the gasoline pump input being connected to the output of the gasoline detergent reservoir. For example, the gasoline pump input can be connected to the output of the gasoline detergent reservoir via a gasoline filter. The gasoline service portion further includes a gasoline output hose having a first end and a second end, the first end of the gasoline output hose being connected to the gasoline pump output and the second end of the gasoline output hose capable of being coupled to the fuel line inlet. For example, the first end of the gasoline output hose can be connected to the gasoline pump output via a gasoline pressure regulator.

These and other aspects of the present invention will become apparent with further reference to the drawings and specification, which follow. It is intended that all such additional systems, methods, features and advantages be included within this description, be within the scope of the present invention, and be protected by the accompanying claims.

BRIEF DESCRIPTION OF THE DRAWINGS

The features and advantages of the present invention will become more readily apparent to those ordinarily skilled in the art after reviewing the following detailed description and accompanying drawings, wherein.

DESCRIPTION OF EXEMPLARY EMBODIMENTS

The present invention may be described herein in terms of functional block components and various processing steps. It should be appreciated that such functional blocks may be realized by any number of hardware components configured to perform the specified functions. It should be further appreciated that the particular implementations shown and described herein are merely exemplary and are not intended to limit the scope of the present invention in any way.

Figure 1:
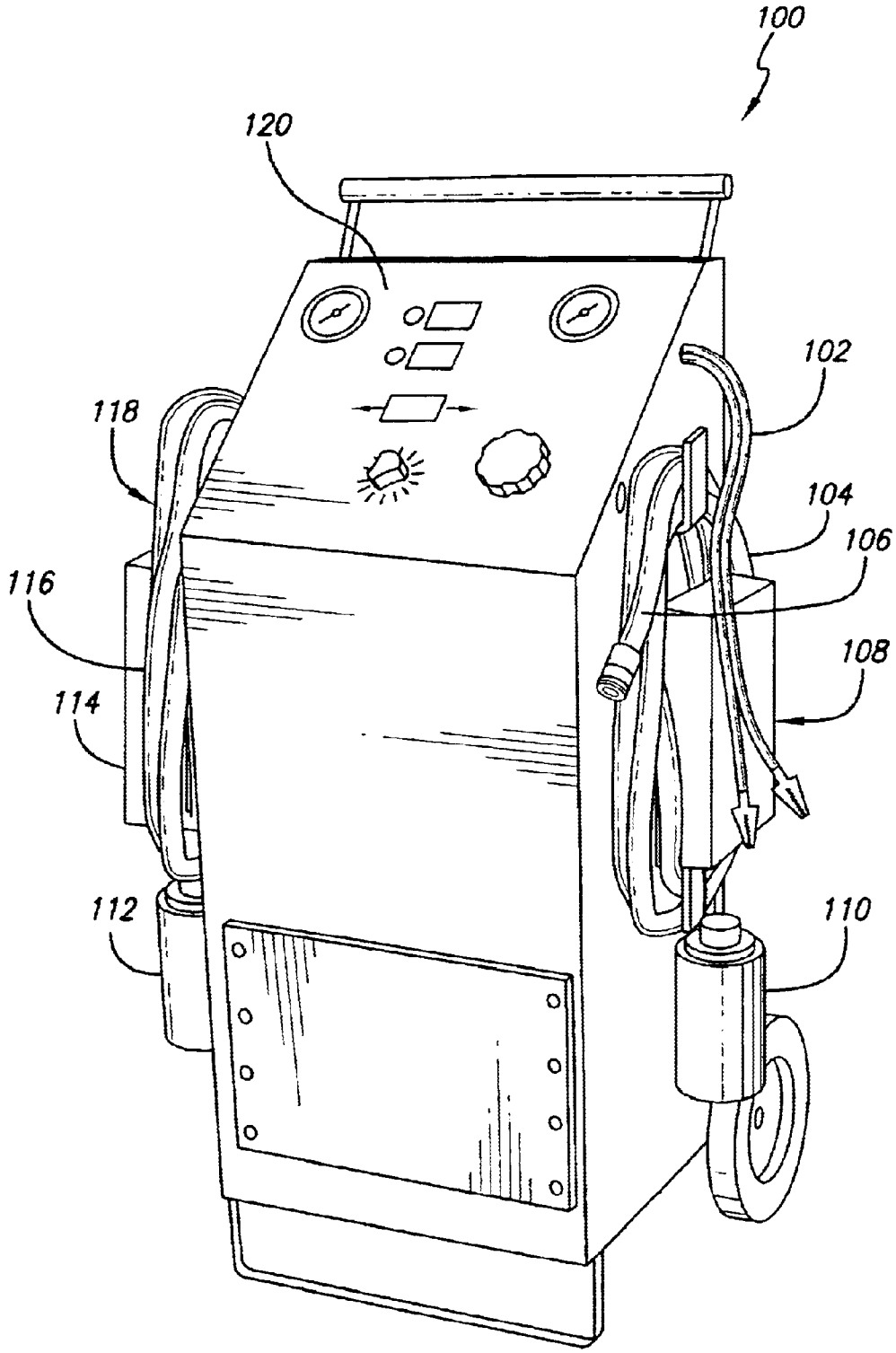
FIG. 1 illustrates an automatic fuel system cleaner according to one embodiment of the present invention.

FIG. 1 shows an automatic fuel system cleaner according to one embodiment of the present invention. As shown in FIG. 1, automatic fuel system cleaner 100 includes power harness 102, which supplies power to automatic fuel system cleaner 100 by connecting to a power source, such as a 12.0 vdc vehicle battery (not shown in FIG. 1). Power harness 102 comprises positive and negative power cables, respectively, that can connect to positive and negative terminals of the power source (not shown in FIG. 1). Automatic fuel system cleaner 100 also includes gas output hose 104 and gas return hose 106. Gas output hose 104 connects to the input side of a machine, such as a vehicle's gasoline engine fuel system (not shown in FIG. 1). Gas return hose 106 connects to the return side of the vehicle's gasoline engine fuel system.

Automatic fuel system cleaner 100 further includes gasoline detergent reservoir 108 and gasoline filter 110. In one embodiment, gasoline detergent reservoir 108 can hold 2.0 liters of a gasoline and detergent clearing mixture. Gasoline filter 110 filters out contaminants that are removed from a vehicle's gasoline engine fuel system during the cleaning process. Automatic fuel system cleaner 100 also includes diesel filter 112 and diesel detergent reservoir 114. Diesel filter 112 filters out contaminants that are removed from a vehicle's diesel engine fuel system during the cleaning process. In one embodiment, diesel detergent reservoir 114 can hold 2.0 liters of a diesel and detergent cleaning mixture.

Automatic fuel system cleaner 100 also includes diesel output hose 116 and diesel return hose 118. Diesel output hose 116 connects to the input side of a vehicle's diesel engine fuel system (not shown in FIG. 1). Diesel return hose 118 connects to the return side of a vehicle's diesel engine fuel system. Automatic fuel system cleaner 100 includes front panel 120. Front panel 120 will be described in detail in relation to FIG. 2.

Figure 2:
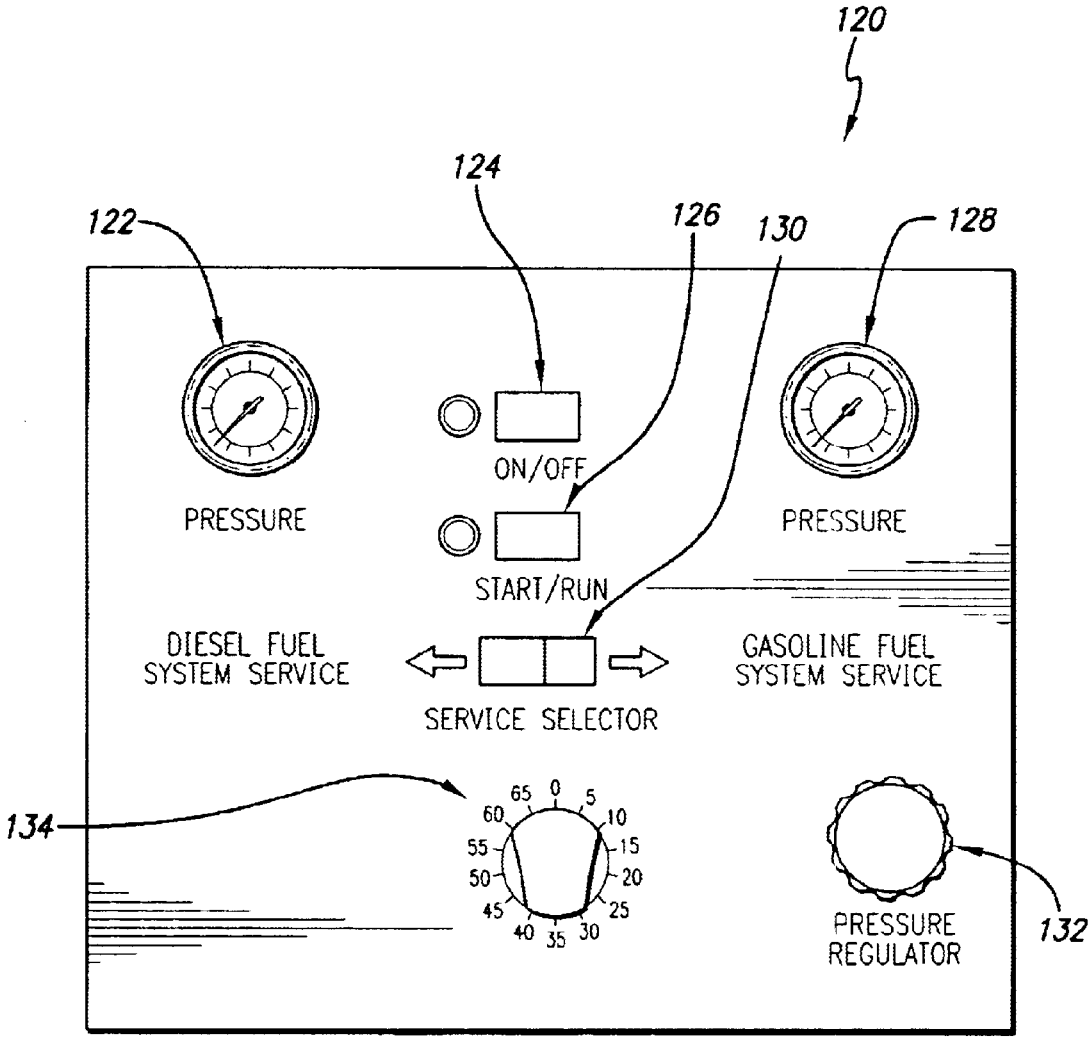
FIG. 2 illustrates the control panel of the automatic fuel system cleaner in FIG. 1.

Referring now to FIG. 2, front panel 120 of FIG. 1 is shown in more detail. As shown in FIG. 2, front panel 120 includes diesel pressure gauge 122. Diesel pressure gauge 122 displays output pressure of diesel output hose 116 of automatic fuel system cleaner 100 in FIG. 1, or pressure of a vehicle's diesel engine fuel system being serviced. Front panel 120 also includes ON/OFF switch 124, which controls power to automatic fuel system cleaner 100. Front panel 120 further includes START/RUN switch 126, which starts the cleaning cycle of automatic fuel system cleaner 100. In one embodiment, START/RUN switch 126 can be a momentary contact switch. Front panel 120 also includes gasoline pressure gauge 128. Gasoline pressure gauge 128 displays output pressure of gas output hose 104 of automatic fuel system cleaner 100 in FIG. 1, or pressure of a vehicle's gasoline engine fuel system being serviced.

Front panel 120 further includes service selector switch 130. Service selector switch 130 selects "diesel" if a diesel engine fuel system is being serviced, or "gasoline" if a gasoline engine fuel system is being serviced. Front panel 120 also includes pressure regulator 132. Pressure regulator 132 adjusts gasoline engine fuel system pressure during the cleaning process. In one embodiment, pressure regulator 132 can be turned clockwise to close or increase pressure, and turned counterclockwise to open or decrease the pressure of the gasoline engine fuel system being serviced by automatic fuel system cleaner 100. Front panel 120 also includes timer control 134, which sets the run-time of automatic fuel system cleaner 100. In one embodiment, timer control 134 can set the run-time of automatic fuel system cleaner 100 in one-minute increments, from one to sixty minutes.

Figure 3:
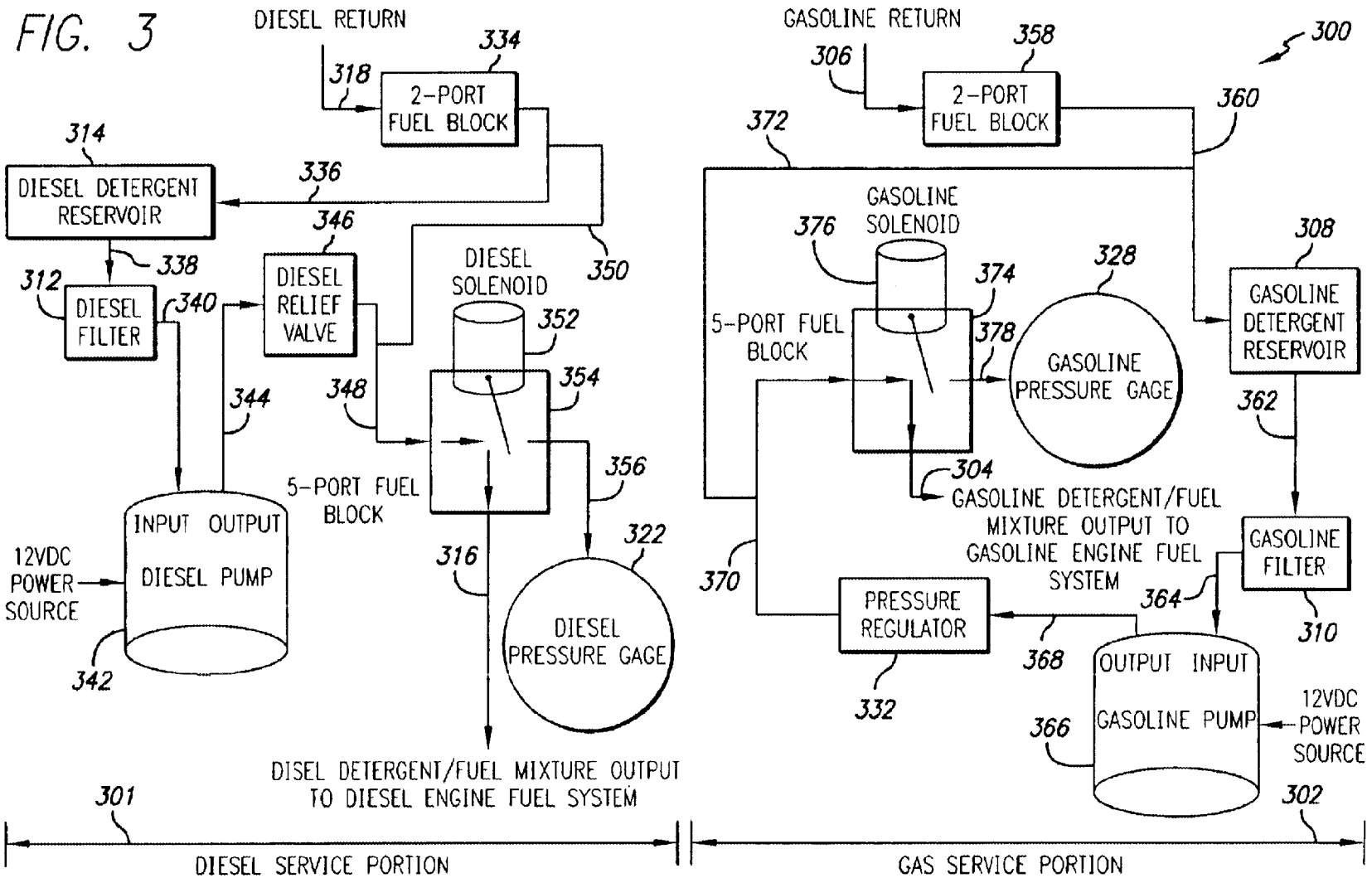
FIG. 3 illustrates a flow diagram of the automatic fuel system cleaner according to one embodiment of the present invention.

Flow schematic 300 of FIG. 3 illustrates the internal structure of automatic fuel system cleaner 100 comprising diesel service portion 301 and gas service portion 302, according to one embodiment of the present invention. Turning to diesel service portion 301 of automatic fuel system cleaner 100, a first end of diesel return hose 318 of automatic fuel system cleaner 100 is connected to 2-port fuel block 334, and a second end of diesel return hose 318 is connected to a diesel engine fuel system (not shown in FIG. 3). 2-port fuel block 334 is connected to diesel detergent reservoir 314 via line 336. Diesel detergent reservoir 314 is also connected to diesel filter 312 via line 338. In one embodiment, diesel filter 312 can be a spin-on canister filter. Diesel filter 312 is connected to the input port of diesel pump 342 via line 340. The output port of diesel pump 342 is connected to diesel relief valve 346 via line 344. In one embodiment, diesel relief valve 346 is set to ensure that diesel fuel line pressure does not exceed 12.0 psi (pounds per square inch). By limiting diesel fuel line pressure to 12.0 psi, diesel relief valve 346 prevents high diesel fuel line pressure from damaging components on the diesel side of automatic fuel system cleaner 100.

Diesel relief valve 346 is connected to 5-port fuel block 354 via line 348. 2-port fuel block 334 is also connected to 5-port fuel block 354 via diesel pressure equalization line 350. Diesel solenoid 352 is attached to 5-port fuel block 354. Diesel solenoid 352 activates the diesel cleaning cycle of automatic fuel system cleaner 100. In one embodiment, diesel solenoid 352 can be a 12.0 vdc electrical solenoid. 5-port fuel block 354 is connected to diesel pressure gauge 322 via line 356. In one embodiment, diesel pressure gauge 322 has a range of 0.0 psi to 30.0 psi. A first end of diesel output hose 316 is connected to 5-port fuel block 354, and a second end of diesel output hose 316 is connected to a diesel engine fuel system (not shown in FIG. 3). Diesel output hose 316 outputs a diesel fuel and detergent mixture to a diesel engine fuel system.

Now, turning to gas service portion 302 of automatic fuel system cleaner 100, a first end of gas return hose 306 of automatic fuel system cleaner 100 is connected to 2-port fuel block 358, and a second end of gas return hose 306 is connected to a gasoline engine fuel system (not shown in FIG. 3). 2-port fuel block 358 is connected to gasoline detergent reservoir 308 via line 360. Gasoline detergent reservoir 308 is connected to gasoline filter 310 via line 362. In one embodiment, gasoline filter 310 can be a spin-on canister filter. Gasoline filter 310 is connected to the input port of gasoline pump 366 via line 364. The output port of gasoline pump 366 is connected to pressure regulator 332 via line 368. In one embodiment, pressure regulator 332 can adjust gasoline fuel line pressure from approximately 6.0 psi to 120.0 psi.

Pressure regulator 332 is connected to 5-port fuel block 374 via line 370. 2-port fuel block 358 is also connected to 5-port fuel block 374 via gasoline pressure equalization line 372. Gasoline solenoid 376 is attached to 5-port fuel block 374. Gasoline solenoid 376 activates the gasoline cleaning cycle of automatic fuel system cleaner 100. In one embodiment, gasoline solenoid 376 can be a 12.0 vdc electrical solenoid. 5-port fuel block 374 is connected to gasoline pressure gauge 328 via line 378. In one embodiment, gasoline pressure gauge 328 has a range of 0.0 psi to 160.0 psi. A first end of gas output hose 304 is connected to 5-port fuel block 374, and a second end of gas output hose 304 is connected to a gasoline engine fuel system (not shown in FIG. 3). Gas output hose 304 outputs a gasoline fuel and detergent mixture to a gasoline engine fuel system. In one embodiment, a power source (not shown in FIG. 3) powers diesel pump 342 and gasoline pump 366. In one embodiment, 12.0 vdc power can be provided by a vehicle's battery.

It should be noted, according to one embodiment, as shown in FIG. 3, diesel fuel does not enter the gasoline fuel system cleaning portion 302 of automatic fuel system cleaner 100; likewise, gasoline fuel does not enter the diesel fuel system cleaning portion 301 of automatic fuel system cleaner 100. Therefore, automatic fuel system cleaner 100 does not have be flushed out or require filters 310 and 312 to be changed when switching from gasoline to diesel, or from diesel to gasoline fuel systems.

Figure 4:
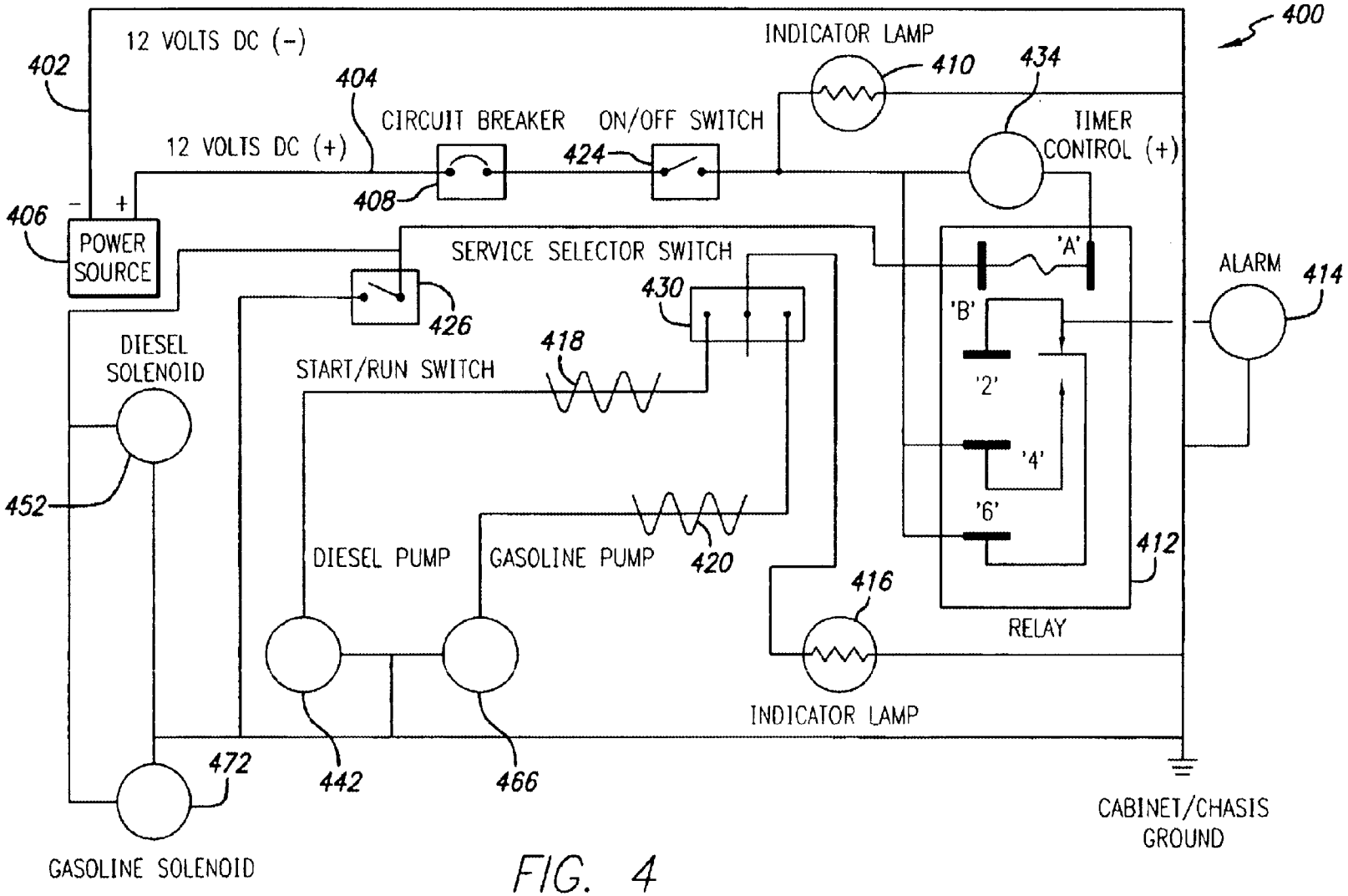
FIG. 4 illustrates an electrical schematic diagram of the automatic fuel system cleaner according to one embodiment of the present invention.

Referring now to FIG. 4, electrical schematic 400 is shown for one embodiment of the present invention. Electrical schematic 400 shows negative power cable 402 and positive power cable 404 connected to power source 406. Power source 406 provides 12.0 vdc power to automatic fuel system cleaner 100. Power source 406 can be a car battery. In one embodiment, power source 406 can be a 110.0/120.0 vac 50.0 or 60.0 cycle power source containing a 12.0 vdc power supply. It should be noted that in other embodiments power source 406 can be a 220.0/240.0 vac 50.0 or 60.0 cycle power source containing a 12.0 vdc power supply, or a 24.0 or 36.0 vdc power source that is converted to 12.0 vdc by a step-down DC to DC voltage converter.

Electrical schematic 400 shows ON/OFF switch 424 for controlling 12.0 vdc power to automatic fuel system cleaner 100. Diagram 400 also shows indicator lamp 410 wired in series with ON/OFF switch 424 so that indicator lamp 410 is lit whenever ON/OFF switch 424 is in the "on" position. Timer control 434 is connected in series with terminals "A" and "B" of relay 412. Thus, when timer control 434 is "on," i.e. timer control 434 is set to run for a predetermined time, and ON/OFF switch 424 is set to the "on" position, 12 vdc is applied to terminal "A" of relay 412. When START/RUN switch 426 is pressed and held, terminal "B" of relay 412 is connected to chassis ground, i.e. the negative terminal of power source 406, and relay 412 is energized. Relay 412 can be, for example, a 12.0 vdc relay capable of handling enough power to power diesel pump 442 and gasoline pump 466. In one embodiment, relay 412 can be a 12.0 vdc relay with a current rating of 15.0 amperes and a voltage rating of 30.0 vdc.

When relay 412 is energized, 12.0 vdc is provided to the center terminal of service selector switch 430 via terminals "4" and "6" of relay 412. Thus, if selector switch 430 is set to the "diesel" position, 12.0 vdc is applied to diesel pump 442 and diesel pump 442 turns on. Similarly, if selector switch 430 is set to the "gasoline" position, 12.0 vdc is applied to gasoline pump 466 and gasoline pump 466 turns on. The selected pump, i.e. diesel pump 442 or gasoline pump 466, will continue to run as long as relay 412 is energized. Relay 412 will remain energized until the time set on timer control 434 expires or START/RUN switch 426 is released. Electrical schematic 400 also shows indicator lamp 416 wired in series with terminals "4" and "6" of relay 412 so that indicator lamp 416 is lit whenever relay 412 is energized.

Electrical schematic 400 shows alarm 414 wired in series with terminals "2" and "6" of relay 412, which are shorted together whenever relay 412 is not energized. When vehicle fuel system service ends, i.e. when the time set by timer control 434 expires, alarm 414 will turn on to signal the completion of service. Electrical schematic 400 also shows diesel solenoid 452 and gasoline solenoid 472, which are wired in series with terminals "A" and "B" of relay 412 and timer control 434. Diesel solenoid 452 and gasoline solenoid 472, which are connected in parallel, will be energized when ON/OFF switch 424 is set to the "on" position and timer control 434 is "on," i.e. timer control 434 is set to run for a specified time period.

Electrical schematic 400 also shows inductor filter coils 418 and 420. Inductor filter coils 418 and 420, respectively, can be wire pass-through filters for diesel pump 442 and gasoline pump 466. Electrical schematic diagram 400 also shows circuit breaker 408 wired in series with power source 406 in order to protect all electrical components of electrical schematic 400. Circuit breaker 408, for example, can be a fuse of a proper rating or a standard switch type circuit.

Figure 5:
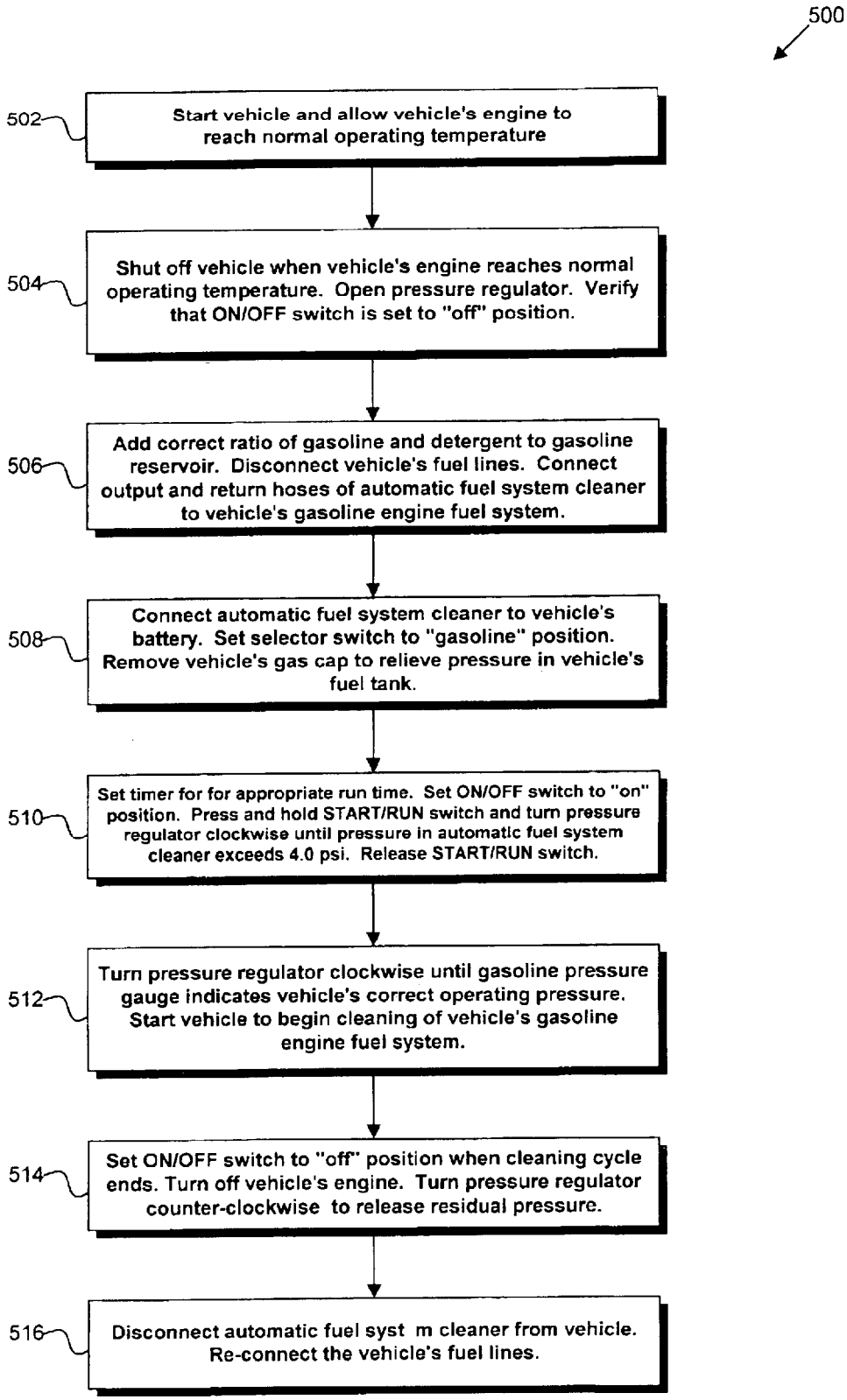
FIG. 5 illustrates a flow diagram of an exemplary method of using the automatic fuel system cleaner of FIG. 1.

FIG. 5 shows flowchart 500 for describing example steps for cleaning a gasoline engine fuel system using automatic fuel system cleaner 100. As shown in FIG. 5, in step 502 a vehicle with a gasoline engine fuel system to be serviced is started, and the vehicle's engine is allowed to reach normal operating temperature. In step 504, the vehicle is shut off when the vehicle's engine reaches normal operating temperature. Next, the pressure regulator, such as pressure regulator 132 in FIG. 2, is opened. For example, pressure regulator 132 may be fully opened by turning it counter-clockwise. It should also be ensured that the ON/OFF switch of automatic fuel system cleaner is set to the "off" position.

In step 506, a correct ratio of gasoline and detergent is added to the gasoline reservoir. For example, a gasoline and detergent mixture containing one (1) ounce of detergent to three (3) ounces of gasoline for each cylinder the vehicle has is added to gasoline reservoir 108 in FIG. 1. Thus, if a vehicle has four cylinders, four (4) ounces of detergent and twelve (12) ounces of gasoline would be added to gasoline reservoir 108. Of course, step 506 may be performed at any time prior to starting automatic fuel system cleaner 100. Next, the vehicle's fuel line(s) are disconnected. For example, if the vehicle has a carburetion type fuel system, the vehicle's fuel line would be disconnected at the inlet of the vehicle's carburetor. By way of further example, if the vehicle has a port fuel injection type fuel system, the vehicle's fuel lines would be disconnected from the vehicle's fuel rail.

The gas output and return hoses are then connected to the vehicle's gasoline fuel system. For example, if the vehicle has a carburetion type fuel system, gas output hose 104 in FIG. 1 would be connected to the inlet of the carburetor via an adaptor, and gas return hose 106 would not be used. Also, in the above example, the fuel line coming from the vehicle's fuel pump may be blocked with an adaptor to prevent fuel from being pumped out of the vehicle's fuel tank.

Next, in step 508, the automatic fuel system cleaner 100 is connected to the vehicle's battery. For example, negative power cable 402 and positive power cable 404 in FIG. 4, respectively, can be connected to the negative and positive terminals of the vehicle's battery. Negative power cable 402 and positive power cable 404 may also be connected, for example, to any automobile battery or power source. The selector switch, such as selector switch 130 in FIG. 2, is set to the "gasoline" position. The vehicle's gas cap is removed to relieve pressure in the vehicle's fuel tank.

In step 510, the timer control is set for an appropriate run-time. For example, if the vehicle has a carburetion type fuel system, timer control 134 in FIG. 2 can be set for a run-time of 30 minutes. The ON/OFF switch, such as ON/OFF switch 124 in FIG. 2, is set to the "on" position. Next, START/RUN switch 126 in FIG. 2 is pressed and held. When START/RUN switch 126 is pressed and held, relay 412 in FIG. 4 is energized and gasoline pump 466 starts to run. Pressure regulator 132 in FIG. 2 is turned clockwise until the gasoline pressure in automatic fuel system cleaner 100 exceeds 4.0 psi as indicated on pressure gauge 128 and START/RUN switch 126 is released. Next, in step 512, pressure regulator 132 is turned clockwise until gasoline pressure gauge 128 indicates the vehicle's correct operating pressure. The vehicle is then started to begin cleaning the vehicle's gasoline engine fuel system.

In step 514, the cleaning cycle ends when the run-time that was set on the timer control, such as timer control 134 in FIG. 2, expires. For example, automatic fuel system cleaner 100 will automatically shut off and alarm 414 in FIG. 4 will sound when the time set on timer control 134 expires. Next, ON/OFF switch 124 in FIG. 2 is set to the "off" position, and the vehicle's engine is turned off. At this point, the pressure regulator, such as pressure regulator 132 in FIG. 2, is turned counterclockwise to release any residual pressure in the gasoline lines of automatic fuel system cleaner 100. In step 516, automatic fuel system cleaner 100 is disconnected from the vehicle and the vehicle's fuel lines are re-connected. For example, if the vehicle has a carburetion type fuel system, gas output hose 104 of automatic fuel system cleaner 100 in FIG. 1 would be disconnected from the inlet of the vehicle's carburetor, and the fuel line coming from the vehicle's fuel pump would be reconnected to the inlet of the vehicle's carburetor.

Figure 6:
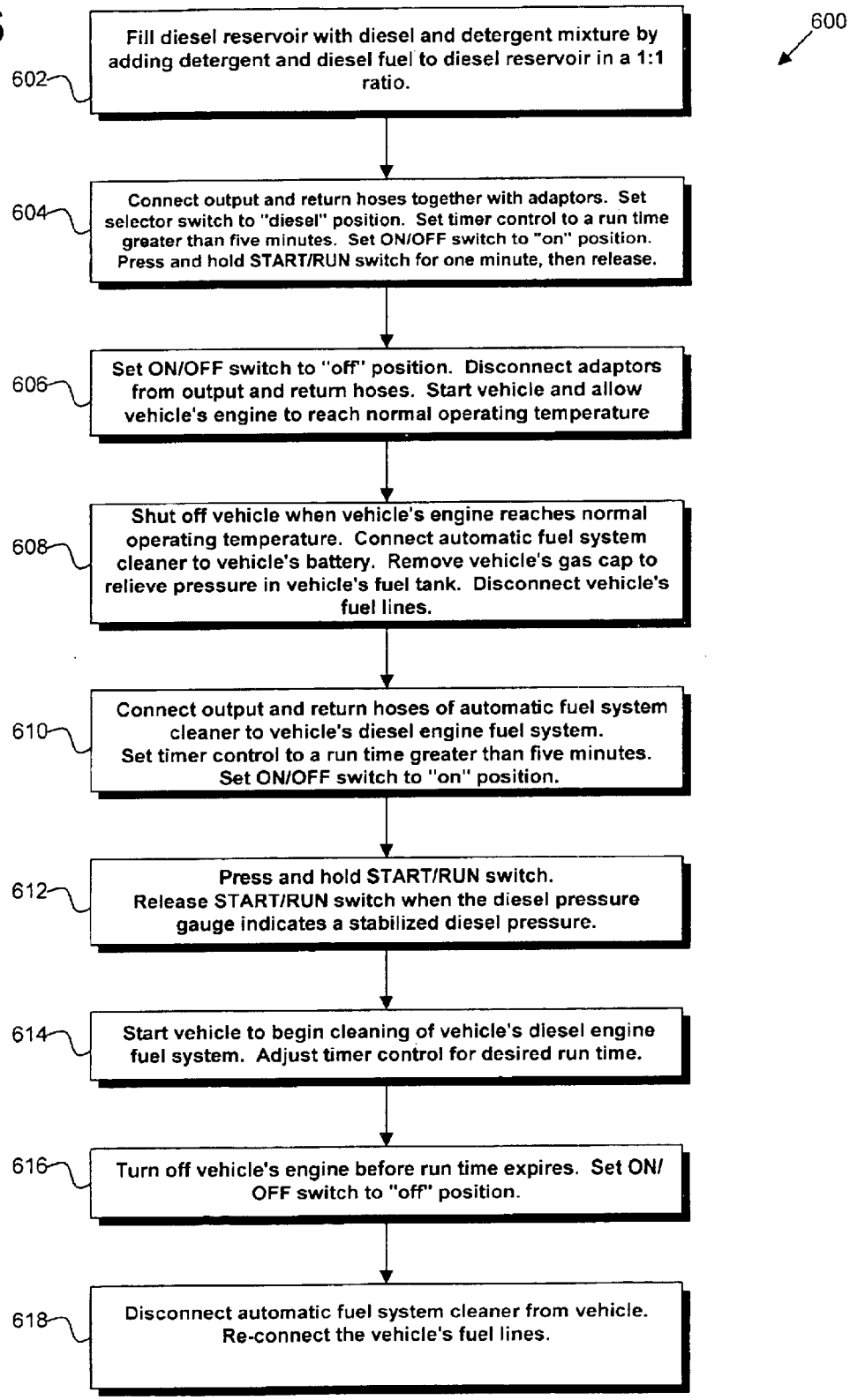
FIG. 6 illustrates a flow diagram of an exemplary method of using the automatic fuel system cleaner of FIG. 1.

FIG. 6 shows flowchart 600 for describing example steps for cleaning a diesel engine fuel system using automatic fuel system cleaner 100. As shown in FIG. 2, in step 602, the diesel reservoir, such as diesel reservoir 114 of automatic fuel system cleaner 100 in FIG. 1, is filled with diesel and detergent mixture by adding detergent and diesel fuel to diesel reservoir 114 in a 1:1 ratio, i.e. one part detergent to one part diesel fuel. In step 604, the output and return hoses, such as diesel output hose 116 and diesel return hose 118 of automatic fuel system cleaner 100 in FIG. 1, are connected together.

Next, selector switch 130 in FIG. 2 is set to the "diesel" position. Timer control 134 is set to a run-time greater than five minutes, and ON/OFF switch 124 in FIG. 2 is set to the "on" position. START/RUN switch 126 is pressed and held for about one minute and then released. In step 606, ON/OFF switch 124 is set to the "off" position, and the adaptors used to connect diesel output hose 116 to diesel return hose 118 in step 604 are disconnected from diesel output hose 116 and diesel return hose 1 18. Next, the vehicle is started and the vehicle's engine is allowed to reach operating temperature.

In step 608, the vehicle is shut off when the vehicle's engine reaches normal operating temperature. Next, automatic fuel system cleaner 100 is connected to the vehicle's battery. For example, negative power cable 402 and positive power cable 404 in FIG. 4, respectively, can be connected to the negative and positive terminals of the vehicle's battery. Negative power cable 402 and positive power cable 404 may also be connected, for example, to any automobile battery or power source. The vehicle's gas cap is removed to relieve pressure in the vehicle's fuel tank, and the vehicle's fuel lines are disconnected. For example, the fuel line going into the vehicle's engine's supply pump and the return line coming from the injectors are disconnected.

Next, in step 610, diesel output hose 116 and diesel return hose 118 of automatic fuel system cleaner 100 are connected to the vehicle's diesel engine fuel system. For example, diesel output hose 116 of automatic fuel system cleaner 100 in FIG. 1 is connected to the pressure line going into the engine's fuel supply side, and diesel return hose 118 is connected to the return line coming from the engine's fuel return. Timer control 134 in FIG. 2 is then set to a run-time greater than five minutes, and ON/OFF switch 124 is set to the "on" position. In step 612, START/RUN switch 126 is pressed and held until a stable diesel pressure indication can be obtained on diesel pressure gauge 122 in FIG. 2. When a stable diesel pressure indication has been obtained on diesel pressure gauge 122, START/RUN switch 126 is released.

In step 614, the vehicle is started to begin cleaning the vehicle's diesel engine fuel system. When automatic fuel system cleaner 100 and the vehicle are running, the run-time can be adjusted on timer control 134. In one embodiment, the default run-time of timer control 134 can be forty-five minutes. In step 616, the vehicle's engine may be shut off just before the run-time set on timer control 134 expires. When the vehicle's engine is shut off, the diesel pump, such as diesel pump 442 in FIG. 4, will continue to run and supply diesel fuel to the engine. When the time set on timer control 134 expires, diesel pump 442 will shut off. Next, set ON/OFF switch 124 in FIG. 2 to the "off" position. The cleaning cycle of the vehicle's diesel engine fuel system is now completed. In step 618, automatic fuel system cleaner 100 is disconnected from the vehicle, and the vehicle's fuel lines are reconnected.

A novel method and system for cleaning a vehicle's diesel or gasoline engine fuel system has been hereby presented. The present invention may be embodied in other specific forms without departing from its spirit or essential characteristics. The described embodiments are to be considered in all respects only as illustrative and not restrictive. Those skilled in the art will recognize that changes and modifications may be made to the embodiments without departing from the scope of the present invention. These and other changes or modifications are intended to be included within the scope of present invention, as broadly described herein.

What is claimed is:

1. An automatic fuel cleaner apparatus for cleaning either a diesel or a gasoline fuel system, said system having a fuel line inlet and a fuel line outlet, said apparatus comprising:

a diesel service portion including:

a diesel return hose having a first end and a second end, wherein said first end of said diesel return hose is capable of being coupled to said fuel line outlet;

a diesel detergent reservoir having an input and an output, wherein said input of said diesel detergent reservoir is connected to said second end of said diesel return hose;

a diesel pump having a diesel pump output and a diesel pump input, said diesel pump input connected to said output of said diesel detergent reservoir;

a diesel output hose having a first end and a second end, wherein said first end of said diesel output hose is connected to said diesel pump output and said second end of said diesel output hose is capable of being coupled to said fuel line inlet;

a gasoline service portion including:

a gasoline return hose having a first end and a second end, wherein said first end of said gasoline return hose is capable of being coupled to said fuel line outlet;

a gasoline detergent reservoir having an input and an output, wherein said input of said gasoline detergent reservoir is connected to said second end of said gasoline return hose;

a gasoline pump having a gasoline pump output and a gasoline pump input, said gasoline pump input connected to said output of said gasoline detergent reservoir; and a gasoline output hose having a first end and a second end, wherein said first end of said gasoline output hose is connected to said gasoline pump output and said second end of said gasoline output hose is capable of being coupled to said fuel line inlet;

wherein said diesel service portion and said gasoline service portion do not share a common hose.

2. The automatic fuel cleaner apparatus of claim 1, wherein said diesel pump input is connected to said output of said diesel detergent reservoir via a diesel filter, and wherein said gasoline pump input is connected to said output of said gasoline detergent reservoir via a gasoline filter.

3. The automatic fuel cleaner apparatus of claim 1, wherein said first end of said diesel output hose is connected to said diesel pump output via a diesel relief valve.

4. The automatic fuel cleaner apparatus of claim 1, wherein said first end of said gasoline output hose is connected to said gasoline pump output via a gasoline pressure regulator.

5. The automatic fuel cleaner apparatus of claim 1, wherein said diesel service portion further includes a diesel solenoid, and wherein said gasoline service portion further includes a gasoline solenoid.

6. The automatic fuel cleaner apparatus of claim 1, wherein said diesel service portion further includes a diesel pressure gauge for displaying an output pressure of said diesel output hose, and wherein said gasoline service portion further includes a gasoline pressure gauge for displaying an output pressure of said gasoline output hose.

* * * * *